United States Patent [19]

Kobori et al.

[11] Patent Number: 4,755,309

[45] Date of Patent: Jul. 5, 1988

[54] COLD WORKING LUBRICANT FOR METALLIC CONDUITS

[75] Inventors: Takeshi Kobori; Shigeki Kimura, both of Yokohama; Tadashi Ito, Yono; Mituru Uemura, Ouaza; Shigeharu Nakamura, Hikoshima; Masamitu Tamura; Kazuhide Takaishi, both of Shimonoseki; Tsuyoshi Matsumoto, deceased, late of Higashi-Nada, all of Japan, by Nobuko Matsumoto, executrix, by Naoko Matsumoto, heiress, by Tatsunori Matsumoto, by Yoji Matsumoto, heirs

[73] Assignee: Nihon Kousakuyu Co., Ltd., Tokyo, Japan

[21] Appl. No.: 777,460

[22] Filed: Sep. 18, 1985

[30] Foreign Application Priority Data

Sep. 19, 1984 [JP] Japan ..... 59-196193

[51] Int. Cl.[4] ..... C10M 103/00

[52] U.S. Cl. ..... 252/49.3; 252/49.5; 252/56 R; 72/42

[58] Field of Search ..... 282/56 R, 49.5, 49.3; 72/42

[56] References Cited

U.S. PATENT DOCUMENTS

| | | | |
|---|---|---|---|
| 3,788,990 | 1/1974 | Elliott et al. | 252/56 R |
| 3,810,836 | 5/1974 | Norton | 252/49.5 |
| 3,896,074 | 7/1975 | Yamamutu et al. | 252/56 R |
| 3,945,930 | 3/1976 | Sugiyama | 252/49.5 |
| 3,980,571 | 9/1976 | Marx | 252/49.5 |
| 4,016,087 | 4/1977 | Narushima et al. | 252/49.3 |
| 4,123,368 | 10/1978 | Leister et al. | 252/56 R |
| 4,461,712 | 7/1984 | Jinnes | 252/49.5 |
| 4,469,611 | 9/1984 | Snyder, Jr. et al. | 252/49.3 |
| 4,474,669 | 10/1984 | Lewis | 252/49.5 |
| 4,496,691 | 1/1985 | Proux et al. | 252/56 R |

FOREIGN PATENT DOCUMENTS

| | | | |
|---|---|---|---|
| 2318131 | 10/1974 | Fed. Rep. of Germany | 252/49.5 |

OTHER PUBLICATIONS

Condensed Chemical Dictionary, p. 346.

*Primary Examiner*—William R. Dixon, Jr.
*Assistant Examiner*—Jerry D. Johnson
*Attorney, Agent, or Firm*—Koda and Androlia

[57] ABSTRACT

A cold working lubricant for metallic conduits in the form of a liquid wherein butyl acrylate ester-methyl methacrylate ester copolymer of 10–40 in resin acid value and −10° to 20° C. in glass transition temperature is emulsified and dispersed; an emulsified product of the straight chain saturated fatty acid or its ester with a melting point of 30°–70° C. can be further added thereto.

2 Claims, 1 Drawing Sheet

COLD WORKING LUBRICANT FOR METALLIC CONDUITS

BACKGROUND OF THE INVENTION

1. Field of the Invention

The present invention relates to lubricant for cold working for metallic conduits, and more particularly to a lubricant for cold working which is highly stable during its storage as well as during its use, excellent in lubricating performance, and also, readily removable after processing work.

2. Prior Art

For processing various types of metallic conduits, such as steel pipe, etc. with cold working (rolling, extrusion, stretching, etc.), various types of lubricants are used for the purpose of quality upgrading of processed products and of inhibitory control on the abrasion (prevention of burning) of the machine shop tools.

However, the commonly known lubricants are not necessarily equipped with all of the required characteristics such as high lubricating performance, readiness in removal after processing, and low polluting potential of the waste solution. For example, in relatively light working processes, plastic process oils, such as metallic soap and mineral oil, or a mixture of them, are used. However, in a process wherein high precision work is required, even when the above mentioned plastic process oils are employed, since the metal contact area between the pipes to be processed and the machine shop tools is large, damage to the tools and products is likely to increase. To cope with the foregoing problems, lubricants with lubricating resin content dissolved in an organic solvent was proposed. However, during use of such lubricant, the solvent becomes volatilized, making it difficult to control the concentration of the components. Further, health hazards due to the volatile solvent are likely to occur.

A relatively new method for lubrication forms a chemical conversion coating over the surface of metallic pipe material in advance to improve lubricating performance by chemical conversion metallic soap coating. This type of conversion coating includes phosphate coating (applied to common steel, low alloy steel, etc.), aluminum fluoride coating (applied to Al or Al-base alloy), oxalate coating (applied to stainless steel, etc.) etc. In this method, a conversion coating is integrated between the pipe to be processed and the chemical converion metallic soap coating, and the foregoing pipe, conversion metallic soap coating and the conversion coating are chemically integrated, respectively. Therefore, the lubricating film shows markedly secure adhesiveness, and even when the rolling reduction (draft) is increased, sufficient lubricating performance is demonstrated.

However, the aforementioned lubricating method using chemcial conversion coating has the following problems:

a. Because the adhesiveness to the material to be processed is very high in degree, acid pickling is indispensable for removing the chemical conversion coating after completion of the processing.

b. Handling of the lubricant is complicated, and also the stability of the treatement effect is somewhat low.

c. A great deal of equipment and labor are required to clean-up the waste solution since a large quantity of waste solution results from the chemical treatment and acid pickling.

d. When the material used is highly corrosive, the chemical conversion treatment itself is difficult to apply and uniform chemical conversion coating cannot be formed. As a result, it is impossible to carry out high precision processing work.

SUMMARY OF THE INVENTION

Accordingly, it is the primary object of the present invention to provide a cold working lubricant for metallic conduits (pipes, tubes), that is free from the problems suffered by conventional lubricants of this type.

It is another object of the present invention to provide a cold working lubricant for metallic pipes, that is a type of a single-part lubrication system different from the lubrication system relying on chemical conversion coating.

It is a specific object of the present invention to provide a cold working lubricant for metallic conduits that is high in lubricating performance as well as in lubricating stability.

It is another object of the present invention to provide a cold working lubricant for metallic conduits that is easily removed from the surface of the processed material after processing.

The above mentioned objects of the present invention are accomplished by preparing a cold working lubricant for metal conduits composed of a liquid containing butyl acrylate estermethyl methacrylate ester copolymer that is −10° to 20° C. in glass transition temperature and is emulsified and dispersed as a single component or as a component copresenting together with straight chain saturated fatty acid or its ester with a melting point of 30°-70° C., in water and a small amount of lower alcohol.

DETAILED DESCRIPTION OF THE INVENTION

The inventors of the present invention selected and set the aforementioned method for lubrication using chemical conversion coatings as the target standard for lubricating performance.

In accordance with the above, the inventors conducted studies on lubricating performance, etc. of numerous compounds in order to develop a lubricant that has bonding force as well as slickness equivalent to those of the above mentioned chemical conversion coating lubrication system and also is free from causing the defects pointed out previously. As a result, the inventors found that butyl arcylate ester-methyl methacrylate ester copolymer has the potential to become a better lubricant than the other resins. In other words, this polymer has a high affinity for metal and shows an outstanding bonding ability. Besides, it has desirable slickness and also can be removed easily with alkaline solution (e.g. aqueous solution of orthosodium silicate), after treatment.

With the foregoing findings obtained, the inventors carried out experiments for clarifying the factors of the copolymer which is able to show the above mentioned characteristics without fail. The experiments led the inventors to the confirmation that, as will be mentioned later in the description of the actual examples, among the copolymers mentioned above, those while are in the range of −10° to 20° C. in glass transition point demonstrate preeminent performance. The copolymers with glass transition temperature below −10° C. are poor in lubricating performance and have a tendency to cause damage to the processed surface due to burning occurring during the cold working. On the other hand, when the glass transition temperature of the copolymers exceeds 20° C., while the lubricating performance itself is satisfactory, indentation due to lubrication coatings tends to occur often. Thus, also in this case, the surface precision of the processed product is downgraded.

Table 1 presents the results of a study on the effect of the glass transition temperature on the lubricating performance of the copolymers with various glass transition points (Tg), which are prepared by varying the copolymerization (copolymer composition) ratio of butyl acrylate ester and methyl methacrylate ester.

Figure 2:
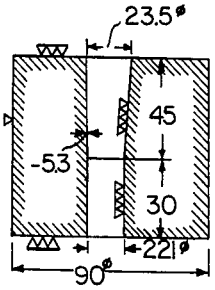
FIG. 2 shows a die used in the steel ball identification test of the present invention.

The steel ball indentation (push-in) test shown in Table 1 is a method to test the performance of the lubricant which is disclosed in Japanese Laid-Open Patent No. 1977-68493. The test is carried out as follows: A die as shown in FIG. 2 is prepared by using a SKD refined material. Then, a test piece (pipe) made of SUS 304 stainless steel and having a size of 22ϕ×19ϕ×1.5 t×40 l is coated with lubricant and inserted into a hole of the foregoing die. Next, steel balls for bearings (the steel ball is 13/16(20.64ϕ)) are pushed into the inner hole of the above mentioned test piece in sequence by using a push rod of 19.1ϕ ×60 1×(end) 1.03 R in size, for causing deformation and the surface conditions of the test piece and steel ball are checked.

The rating standard for the steel ball indentation test is as shown below:

Surface Flaw of the Steel Ball

XX . . . Extensive burning caused
X . . . Burning caused slightly
Δ. . . Cloudiness observed
○ . . . No abnormality seen Condition of Internal Surface of the Pipe: Fraw XX . . . Extensive (serious) burning caused
X . . . Burning caused slightly
Δ. . . Metallic luster due to breakage of oil film seen
○ . . . Metallic luster seen partially
◎ . . . Uniform lubrication film observed Condition of Internal Surface of the Pipe: Indentation XX . . . Extensive indentation due to lubrication film caused
X . . . Strongly indented scars seen locally
Δ . . . Light indentation shown partially
○ . . . Slight indentation shown partially
◎ . . . Absolutely no indentation observed

TABLE 1

| NUMBER | | | 1 | 2 | 3 | 4 | 5 | 6 | 7 | 8 | 9 | 10 |
|---|---|---|---|---|---|---|---|---|---|---|---|---|
| COMPOSITION (%) | Butyl Acrylate Ester | | 30 | 35 | 40 | 45 | 50 | 55 | 60 | 65 | 70 | 75 |
| | Methyl Methacrylate Ester | | 70 | 65 | 60 | 55 | 50 | 45 | 40 | 35 | 30 | 25 |
| Glass Transition Temperature (°C.) | | | 37 | 25 | 20 | 12 | 4 | −4 | −10 | −17 | −23 | −30 |
| STEEL BALL INDENTATION TEST | Condition of Internal Surface of the Pipe | Flaw | ◎ | ◎ | ◎ | ◎ | ◎ | ○ | Δ | X | XX | XX |
| | | Indentation | XX | X | Δ | ○ | ○ | ○ | ◎ | ◎ | ◎ | ◎ |
| | Scar on Surface of Steel Ball | | ◎ | ◎ | ◎ | ◎ | ○ | ○ | ○ | ○ | Δ | X |
| | Maximum Load (Ton) | | 7.5 | 6.8 | 5.5 | 5.0 | 5.1 | 4.9 | 4.8 | 4.5 | 4.5 | 4.4 |

Figure 1:
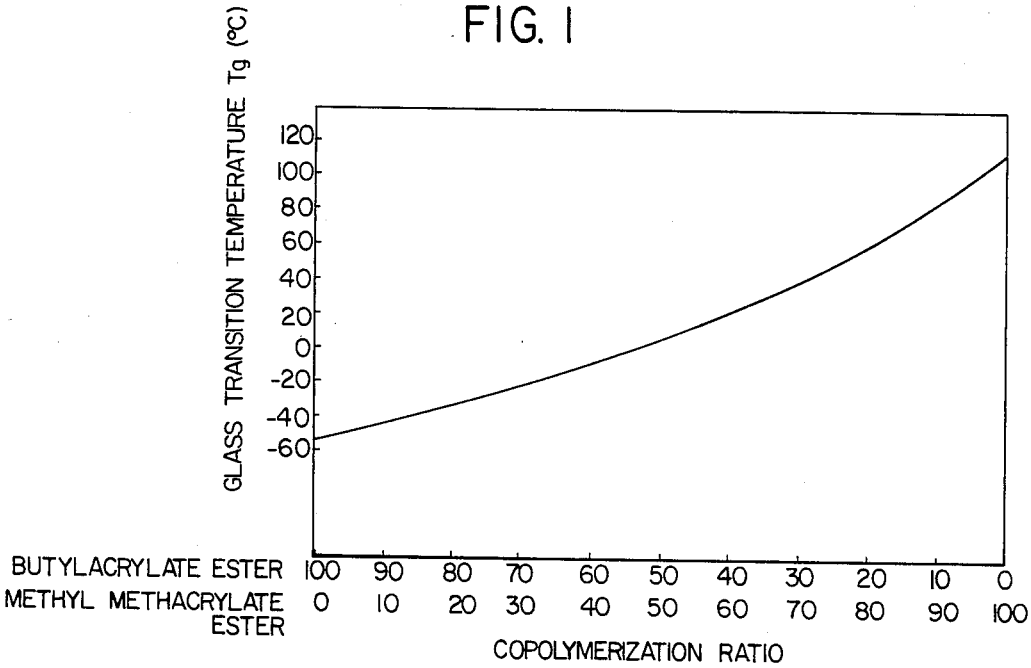
FIG. 1 is a graph showing the relation between the composition ratio of the copolymer of butyl acrylate ester and methyl methacrylate ester and the glass transition temperature.

As is apparent from Table 1, when a copolymer of butyl acrylate ester and methyl methacrylate ester that is within the range of −10° to 20° C. in glass transition temperature is used a metal pipe with superior surface precision can be obtained. FIG. 1 shows the correlation between the copolymer composition ratio of butyl acrylate ester-methyl methacrylate ester and the glass transition temperature.

In addition, to the factors mentioned above, it was found that the acid value of the aforementioned copolymer has a significant effect on the lubricating performance and the readiness for removal after the treatment, etc. Thus, the results of the confirming experiments clearly indicate that the copolymers which are 10–40 in acid value must be used. When the acid value of the copolymer is below 10, the hydrophilicity is not enough, making it difficult to remove the lubricant with alkaline solution (for example, aqueous solution of ortho-silicate of soda) after the treatment. On the other hand, when the acid value exceeds 40, emulsification stability of the resin is lowered, and also the emulsified solution become gelatinous by showing thixotropy. As a result, the suitability as a lubricant is lost.

Next, a study on the morphology of the foregoing copolymer for its use as a lubricant resulted in confirming that the best appropriate form is an aqueous emulsion. It means that, when those copolymers are used in the form of an aqueous emulsion, catching on fire, etc. due to volatile vapor as seen in when using organic solvent type lubricants can be eliminated. Furthermore, removal through washing with an alkaline solution after the treatment can be performed easily.

For emulsification, when a small amount of lower alcohol (isopropyl alcohol, etc.) is used together with water, the stability of the emulsion can be further improved. The concentration of the polymer contained in the emulsion is not limited specifically, but the most preferable concentration when readines for handling, lubricating performance, etc. are taken into consideration, is about 20–60 weight % (around 40 weight % is even more preferable).

The objects of the present invention can be achieved when the copolymer emulsion mentioned above is used as the lubricant. However, the lubricating performance, etc. of the copolymer emulsion is remarkably enhanced further when used together with straight chain saturated fatty acid which has a melting point ranging from 30° to 70° C. or its ester. More specifically, both of the straight chain saturated fatty acid and its ester are high in thermal stability and low in coefficient of friction in the relatively low temperature range. Accordingly, they are high in affinity for and conformability with the phase boundary of the material to be processed in the state of boundary lubrication, thereby improving the resistivity against burning. Furthermore, they function to soften the above mentioned copolymer quality, thus contributing to further improve the function of the copolymer. Therefore, through the joint use of either one or both of the above mentioned straight chain saturated fatty acids and its ester together with the foregoing polymer, a lubricant for cold working with excellent performance can be obtained.

However, the saturated fatty acid that has a melting point below 30° C. or its ester, does not show the previously mentioned effects (particularly, the effect of preventing burning) sufficiently. On the contrary, when the melting point of the foregoing saturated fatty acid or its ester is over 70° C., emulsification becomes difficult or it becomes difficult to obtain a stable emulsion.

As the straight chain saturated fatty acids which meet the requirements described above, fatty acids obtained from natural fats and oils, which have about 14–22 carbons (for example, myristic acid, palmitic acid, stearic acid, etc.) are desirable examples.

Such types of fatty acids and their esterification products lack emulsifiability. However, when a surface active agent (preferably nonionic polyoxyalkyl ethylene ether, etc.) in an amount of about 0.4–0.5 parts by weight compared with 1 part by weight of fatty acid or its ester is used in combination, a stable emulsion can be obtained.

No specific limits are set as to the composition (ratio) of the foregoing copolymer and the straight chain saturated fatty acid (or its ester), but the preferable range for it is 35-5% for the latter against 65–95% for the former, in amount of nonvolatile matter content.

The above mentioned mixed emulsion may be prepared by mixing respectively appropriate amounts of copolymer emulsion and fatty acid (or its ester) emulsion (emulsified solution) through preparing these two types of emulsions separately. Or, the mixed emulsions may be prepared by mixing the copolymer and the fatty acid (or its ester) in a solid state with the appropriate surfactant, and then emulsifying them simultaneously. Also, if a small amount of solid lubricant, such as metallic soap, graphite, etc. is compounded in the mixed emulsion prepared as mentioned above, the protecting effect for the newly formed surface during cold working is upgraded, resulting in further extending the life of work shop tools.

EXAMPLE 1

Butyl acrylate ester/methyl methacrylate ester copolymer that is 13° C. in glass transition temperature, 20 in acid value (KHO mg/g), and 37600 in average molecular weight was emulsified and dispersed in a mixed solvent of water and a small amount of isopropyl alcohol. As a result, a lubricant of 39 weight % in nonvolatile components concentration was prepared. For the lubricant thus obtained, a pull-out test was conducted by varying the drawing mode. For the pull-out test, a floating plug of SUS 304 steamless pipe (22 m $\phi \times 2.2$ mm t) was used. In the test, the state of the plugs, flaws in the pipes and the aspect of indentation after drawing the pipes up to 17 mm $\phi \times 1.4$ mm t, 1.6 mm t, 1.8 mm t and 2.0 mm t, respectively, were compared.

The results of the test are shown in Table 2. Satisfactory results were obtained in the cases with low area reduction. However, with the increase of reduction area, problems occurred in relation to the performance of the lubricant.

The criteria for evaluation of the pull-out test results are shown below:

State of the Plug

XX . . . Extensive burning caused (serious)
X . . . Slight burning caused
Δ . . . Cloudiness observed
○ . . . No abnormality Aspect of Scarring of the Pipe XX . . . Burnt heavily
X . . . Burning slightly occured
Δ . . . Metallic luster due to oil film breakage seen
○ . . . Metallic luster partially shown
⊙ . . . Uniform lubricant film observed State of Indentation XX . . . Extensively indented by the lubrication coating
X . . . Severe indentation seen locally
Δ . . . Light indentation formed locally
○ . . . Slight indentation caused partially
⊙ . . . Absolutely no indentation shown

TABLE 2

| | | | No. 1 | No. 2 | No. 3 | No. 4 |
|---|---|---|---|---|---|---|
| Drawing Mode (mm) | | | 22ϕ × 2.2t ↓ 17ϕ × 2.0t | 22ϕ × 2.2t ↓ 17ϕ × 1.8t | 22ϕ × 2.2t ↓ 17ϕ × 1.6t | 22ϕ × 2.2t ↓ 17ϕ × 1.4t |
| Reduction in Area (%) | | | 31.1 | 37.2 | 43.4 | 49.9 |
| PULL OUT TEST | State of Plug | | ⊙ | Δ | X | XX |
| | State of Pipe | | | | | |
| | External surface | Flaw | ⊙ | ○ | X | XX |
| | | Indentation | Δ | Δ | — | — |
| | Internal Surface | Flaw | ⊙ | ○ | Δ | Δ |
| | | Indentation | Δ | Δ | ○ | ○ |
| Maximum Drawing Load (Ton) | | | 4.4 | 6.2 | 7.8 | 8.5 |

EXPERIMENTAL EXAMPLE 2 (COLD PILGER MILL TEST)

The butyl acrylate ester-methyl methacrylate ester copolymer emulsion, fatty acid emulsion and fatty acid ester emulsion described below were compounded with the ratio shown in Table 3(1) and 3(2). The mixed emulsion thus obtained was used as a lubricant for rolling SUS 304 seamless pipe (55 mm $\phi \times 5.5$ mm t) up to 31 mm $\phi \times 3.0$ mm t by using the Pilger Mill System, and the aspect of flaw of the pipe and the state of indentation were checked.

Emulsions used for the Test

A: Butyl acrylate ester-methyl methacrylate ester copolymer emulsion
Glass transition temperature . . . 20° C.
Acid value . . . 20
*Nonvolatile matter content . . . 38 weight %*

B: Straight chain saturated fatty acid emulsion
Carbon number . . . 14 (myristic acid)
Melting point . . . 54° C.
Surface active agent . . . Polyoxy alkylethylene ether, 4.5 weight %
Concentration of fatty acid . . . 9 weight %

C: Straight chain saturated fatty acid ester emulsion
Number of carbons . . . 22
Melting point . . . 80° C. (before esterification)
Surface active agent . . . Polyoxyethyle sorbitan-monooleate, 4.5 weight %
Concentration fatty acid ester . . . 9 weight %

The results of the test are shown in Table 3(1) and 3(2). It is indicated that the use of the appropriate amount of the emulsified solution of straight chain saturated fatty acid or its ester, together with the butyl acrylate ester-methyl methacrylate ester copolymer emulsion, brings about a substantial improvement in lubricating performance.

TABLE 3(1)

| Lubricant | | | | 1 | 2 | 3 | 4 | 5 | 6 | 7 | 8 | 9 | 10 |
|---|---|---|---|---|---|---|---|---|---|---|---|---|---|
| Composition of Lubricant | | Copolymer Emulsion | | 20 | 25 | 30 | 40 | 50 | 60 | 70 | 80 | 85 | 90 |
| | | Fatty Acid Emulsion | | 80 | 75 | 70 | 60 | 50 | 40 | 30 | 20 | 15 | 10 |
| Performance Rating | Stability of Solution | | | ○ | ○ | ○ | ○ | ○ | ○ | ○ | ○ | ○ | ○ |
| | Rolling Test | Inner Surface of Tube | Flaw | X | Δ | ○ | ○ | ◎ | ◎ | ◎ | ◎ | ◎ | ◎ |
| | | | Indentation | ◎ | ◎ | ◎ | ◎ | ◎ | ◎ | ◎ | ◎ | ◎ | Δ |
| | | Outer Surface of Tube | Flaw | X | Δ | ○ | ◎ | ◎ | ◎ | ◎ | ◎ | ◎ | ◎ |
| | | | Indentation | ◎ | ◎ | ◎ | ◎ | ◎ | ◎ | ◎ | ◎ | ○ | Δ |

TABLE 3(2)

| Lubricant | | | | 11 | 12 | 13 | 14 | 15 | 16 | 17 | 18 | 19 | 20 |
|---|---|---|---|---|---|---|---|---|---|---|---|---|---|
| Composition of Lubricant | | Copolymer Emulsion | | 20 | 25 | 30 | 40 | 50 | 60 | 70 | 80 | 85 | 90 |
| | | Fatty Acid Ester Emulsion | | 80 | 75 | 70 | 60 | 50 | 40 | 30 | 20 | 15 | 10 |
| Performance Rating | Stability of Solution | | | ○ | ○ | ○ | ○ | ○ | ○ | ○ | ○ | ○ | ○ |
| | Rolling Test | Inner Surface of Tube | Flaw | X | Δ | ○ | ◎ | ◎ | ◎ | ◎ | ◎ | ◎ | ◎ |
| | | | Indentation | ◎ | ◎ | ◎ | ◎ | ◎ | ◎ | ◎ | ◎ | ◎ | ○ |
| | | Outer Surface of Tube | Flaw | X | Δ | ○ | ◎ | ◎ | ◎ | ◎ | ◎ | ◎ | ◎ |
| | | | Indentation | ◎ | ◎ | ◎ | ◎ | ◎ | ◎ | ◎ | ◎ | ◎ | Δ |

EXPERIMENTAL EXAMPLE 3 (DRAWING TEST FOR CYLINDRICAL STEEL PLATE

By using cylindrical steel plates as the processing material, cylindrical drawing tests were conducted as to the lubricant mentioned below, under the conditions shown below. Table 4 shows the processing resutls for various drawing ratios. Also, for comparison, the results of experiments conducted by using the press cutting (metal working) oil No. 640 from Nippon Kosakuyu Co. are shown in the same table.

Conditions for Cylinder Drawing

Punch: 40 mm $\phi$, shoulder 4.5 mmR
Flat head punch . . . SKD-11, HR SKD 11, HR
Die: 42.58 mm $\phi$, shoulder 9.1 mmR
Drawing Rate : 20 m/min
Wrinkle presser: 700 kg Composition of Lubricant Used for the Test Butyl acrylate ester-methyl methacrylate ester copolymer emulsion
Glass transition temperature . . . 5° C.
Acid value . . . 30
Concentration of nonvolatile matter content . . . 37.5 weight %

Straight chain saturated fatty acid emulsion
Number of carbons . . . 14 (muyristic acid)
Melting Point . . . 54° C.
Surfactant . . . Polyoxyalkyletheylene ether 4.5 weight %
Concentration of fatty acid . . . 9 weight %

The mixture of the above mentioned copolymer emulsion (70 parts by weight) and fatty acid emulsion (30 parts by weight).

As should be apparent from Table 4, through the use of the lubricant provided by the present invention, the drawing ratio can be improved substantially in comparison with the case using the standard lubricant.

TABLE 4

| | Blank Diameter | | | | | | | | |
|---|---|---|---|---|---|---|---|---|---|
| | 92 | 93 | 94 | 95 | 96 | 97 | 98 | 99 | 100 |
| Contraction Ratio (D/d) | 2.3 | 2.325 | 2.35 | 2.375 | 2.4 | 2.425 | 2.45 | 2.475 | 2.5 |
| Lubricant | ○ | ○ | ○ | ○ | ○ | ○ | ○ | ○ | X |

TABLE 4-continued

| | Blank Diameter | | | | | | | | |
|---|---|---|---|---|---|---|---|---|---|
| | 92 | 93 | 94 | 95 | 96 | 97 | 98 | 99 | 100 |
| Used | ○ | ○ | ○ | ○ | ○ | ○ | ○ | X | X |
| Standard | ○ | ○ | ○ | ○ | X | X | — | — | — |
| Lubricant | ○ | ○ | ○ | ○ | X | X | — | — | — |

(No. 640)

○: Satisfactory Drawing
X: Rupture
In the above, D/d = (blank diameter)/(punch diameter)
The test was conducted twice for each blank.

EXAMPLE 4 (FLOATING PLUG DRAWING TEST

Mixed emulsions obtained by compounding the butyl acrylate ester-methyl methacrylate ester copolymer emulsion, the fatty acid emulsion and the fatty acid ester emulsion as shown below with the composition ratio listed in Table 5 were used as the lubricant. The floating plug drawing was conducted for SUS 304 seamless pipe (22 mm $\phi \times 2.2$ mm t) down to 17 mm $\phi \times 1.4$ mm t. Then, the state of the plug, the condition of the flaw of the pipe, and the aspect of the indentation were compared. The results are shown collectively in Table 5.

Emulsions Used for the Test

A: Butyl acrylate ester-methyl methacrylate ester copolymer emulsion
Glass transition temperature . . . 13° C.
Acid number . . . 20
Concentration of nonvolatile components . . . 39 weight %

B: Straight chain saturated fatty acid emulsion
Carbon number . . . 18
Melting point . . . 69° C.
Surfactant . . . Polyoxyalkylethylene ether, 4.5 weight %
Concentration of fatty acid . . . 9 weight %

C. Straight chain saturated fatty acid ester emulsion
Number of carbons . . . 16
Melting point . . . 63° C. (before esterification)
Surfactant . . . Polyoxyalkylethylene ether 4.5 weight %
Concentration of fatty acid ester . . . 9 weight %

As is clearly seen in Table 5, the scar of the processed pipe and the indentation of it tend to be opposite in their shown conditions. However, the mixture obtained by compounding the appropriate amounts of the copolymer and the fatty acid (or its ester) is satisfactory in stability, and also gives desirable results for every item of the drawing test. Furthermore, every lubricant could be almost completely removed through immersion for 2–3 minutes at 40° C. by using ortho-sodium silicate of about 3% in concentration as the cleaning solution.

TABLE 5

| Lubricant | | 1 | 2 | 3 | 4 | 5 | 6 | 7 | 8 | 9 | 10 | 11 | 12 |
|---|---|---|---|---|---|---|---|---|---|---|---|---|---|
| Lubricant (wt %) | | | | | | | | | | | | | |
| Copolymer Emulsion | | 30 | 40 | 50 | 60 | 70 | 80 | 30 | 40 | 50 | 60 | 70 | 80 |
| Fatty Acid Emulsion | | 70 | 60 | 50 | 40 | 30 | 20 | — | — | — | — | — | — |
| Fatty Acid Ester Emulsion | | — | — | — | — | — | — | 70 | 60 | 50 | 40 | 30 | 20 |
| Performance Rating | | | | | | | | | | | | | |
| Stability Solution | | ○ | ○ | ○ | ○ | ○ | ○ | ○ | ○ | ○ | ○ | ○ | ○ |
| Drawing Test | | | | | | | | | | | | | |
| Plug Condition | | Δ | Δ | Δ | Δ | Δ | ○ | Δ | Δ | Δ | Δ | ○ | ○ |
| Condition | | | | | | | | | | | | | |
| Pipe Condition | | | | | | | | | | | | | |
| Inner Surface | Flaw | ⊙ | ⊙ | ⊙ | ○ | ○ | ○ | ⊙ | ⊙ | ⊙ | ○ | ○ | ○ |
| | Indentation | Δ | Δ | Δ | ○ | ○ | ○ | Δ | Δ | ○ | ⊙ | ⊙ | ⊙ |
| Outer Surface | Flaw | Δ | Δ | Δ | ○ | ○ | ○ | Δ | Δ | ○ | ○ | ⊙ | ⊙ |
| | Indentation | ⊙ | ⊙ | ⊙ | ○ | Δ | Δ | ⊙ | ⊙ | ⊙ | ⊙ | ○ | Δ |
| Maximum Drawing Load (ton) | | 7.2 | 7.1 | 6.9 | 6.8 | 6.8 | 7.1 | 7.0 | 6.8 | 6.2 | 5.8 | 5.5 | 6.2 |

The present invention is composed as mentioned above. Basically, by using an emulsion composed primarily of butyl acrylate ester-methyl methacrylate ester copolymer with a specified resin acid value and glass transition temperature, or the above mentioned copolymer together with a straight chain saturated fatty acid or its ester with a specified melting point, as the lubricant, the advantages listed below can be obtained.

1. This lubricant is not the type that uses a chemical reaction as in chemical conversion treatment. Therefore, the lubricant can be removed easily after processing. In addition, the acid pickling bath, the salt bath, etc. are unnecessary. Consequently, equipment cost can be cut down.

2. Since the lubricant can be provided in the form of a single-liquid, the lubrication process can be done simply. The only requirements are to immerse the material to be processed in this lubricant and to dry the material. Besides, the processing cost is low.

3. Since this type of lubricant functions by adhering the lubricant physically, it can be applied to all types of metallic conduits.

4. Since the lubricant has a high affinity for the material to be processed and is very slick, burning is prevented and an extremely smooth and beautiful surface texture can be obtained by using it.

5. No problems are caused even if the lubricating treatment, the draw-stretching, or the rolling is carried out without removing the oxide film formed during annealing of the processed pipe.

6. During rolling, water, aqueous emulsions, or oils with low coefficient viscosities are sometimes supplied from the outside for cooling as well as for helping with lubrication. In such a case, the lubricant does not interfere with the performance of the water, aqueous solution or low viscosity oil

We claim:

1. A cold work lubricant for metallic conduit comprising a butyl acrylate ester-methyl methacrylate ester copolymer that is 10–40 in resin acid value and −10° to 20° C. in glass transistion temperature emulsified-dispersed in water and lower alcohol.

2. A cold working lubricant for metallic conduits comprising a butyl acrylate ester-methyl methacrylate ester copolymer that is 10–40 in resin acid value and −10° to 20° C. in glass transition temperature; and an emulsified product of straight chain saturated fatty acid or its ester that has a melting point of 30°–70° C., said copolymer and emulsified product being compounded in water or a liquid containing water and a small amount of lower alcohol so as to be emulsified-dispersed.

* * * * *